US009625847B2

(12) United States Patent
Shoji et al.

(10) Patent No.: US 9,625,847 B2
(45) Date of Patent: Apr. 18, 2017

(54) ELECTROSTATIC CHARGE IMAGE DEVELOPING CARRIER, ELECTROSTATIC CHARGE IMAGE DEVELOPER, DEVELOPER CARTRIDGE, PROCESS CARTRIDGE, AND IMAGE FORMING APPARATUS

(71) Applicant: FUJI XEROX CO., LTD., Tokyo (JP)

(72) Inventors: Takeshi Shoji, Kanagawa (JP); Hiroshi Kamada, Kanagawa (JP); Yosuke Tsurumi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/604,034

(22) Filed: Jan. 23, 2015

(65) Prior Publication Data

US 2016/0062256 A1 Mar. 3, 2016

(30) Foreign Application Priority Data

Sep. 1, 2014 (JP) ..... 2014-177373

(51) Int. Cl.
*G03G 9/113* (2006.01)
*G03G 15/08* (2006.01)

(52) U.S. Cl.
CPC ..... *G03G 9/1133* (2013.01); *G03G 9/1135* (2013.01); *G03G 15/08* (2013.01); *G03G 2215/0132* (2013.01); *G03G 2215/0607* (2013.01)

(58) Field of Classification Search
CPC ..... G03G 9/1132; G03G 9/1133
See application file for complete search history.

(56) References Cited

U.S. PATENT DOCUMENTS

| | | | | |
|---|---|---|---|---|
| 2005/0100808 | A1* | 5/2005 | Hashimoto | G03G 9/0806 430/108.8 |
| 2005/0112489 | A1* | 5/2005 | Fujikawa | G03G 9/0804 430/111.35 |
| 2010/0021209 | A1* | 1/2010 | Watanabe | G03G 9/0804 399/252 |
| 2012/0003579 | A1* | 1/2012 | Iwata | G03G 9/107 430/111.32 |
| 2012/0214098 | A1* | 8/2012 | Fukushima | G03G 9/0819 430/111.35 |
| 2014/0370432 | A1* | 12/2014 | Veregin | G03G 9/1138 430/108.7 |

FOREIGN PATENT DOCUMENTS

| | | |
|---|---|---|
| JP | 2013-44766 A | 3/2013 |
| JP | 2014-48455 A | 3/2014 |

* cited by examiner

*Primary Examiner* — Hoa V Le
(74) *Attorney, Agent, or Firm* — Sughrue Mion, PLLC

(57) ABSTRACT

An electrostatic charge image developing carrier contains a core particle and a resin coat layer on a surface of the core particle, wherein the core particle has a BET specific surface area of from 0.05 $m^2/g$ to 0.10 $m^2/g$, and the resin coat layer contains a nitrogen-containing (meth)acrylate resin.

13 Claims, 2 Drawing Sheets

ELECTROSTATIC CHARGE IMAGE DEVELOPING CARRIER, ELECTROSTATIC CHARGE IMAGE DEVELOPER, DEVELOPER CARTRIDGE, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2014-177373 filed Sep. 1, 2014.

BACKGROUND

1. Technical Field

The present invention relates to an electrostatic charge image developing carrier, an electrostatic charge image developer, a developer cartridge, a process cartridge, and an image forming apparatus.

2. Related Art

In electrophotography of the related art, a method is used, the method including: forming an electrostatic charge image on an image holding member (electrophotographic photoreceptor) or an electrostatic recording medium using various units; and attaching voltage-detecting particles called toner to the image holding member or the electrostatic recording medium to develop the electrostatic charge image thereon.

In order to develop the electrostatic charge image, a toner and a carrier are mixed and are frictionally charged to apply a positive or negative charge to the toner, and used.

In general, the carrier is broadly classified into a carrier in which a coating layer is not formed on surfaces of core particles; and a resin-coated carrier in which a coating layer including a resin is formed on surfaces of core particles.

SUMMARY

According to an aspect of the invention, there is provided an electrostatic charge image developing carrier containing:

a core particle; and a resin coat layer on a surface of the core particle, wherein the core particle has a BET specific surface area of from 0.05 $m^2/g$ to 0.10 $m^2/g$, and the resin coat layer contains a nitrogen-containing (meth) acrylate resin.

BRIEF DESCRIPTION OF THE DRAWINGS

Exemplary embodiments of the present invention will be described in detail based on the following figures, wherein.

DETAILED DESCRIPTION

Figure 1:
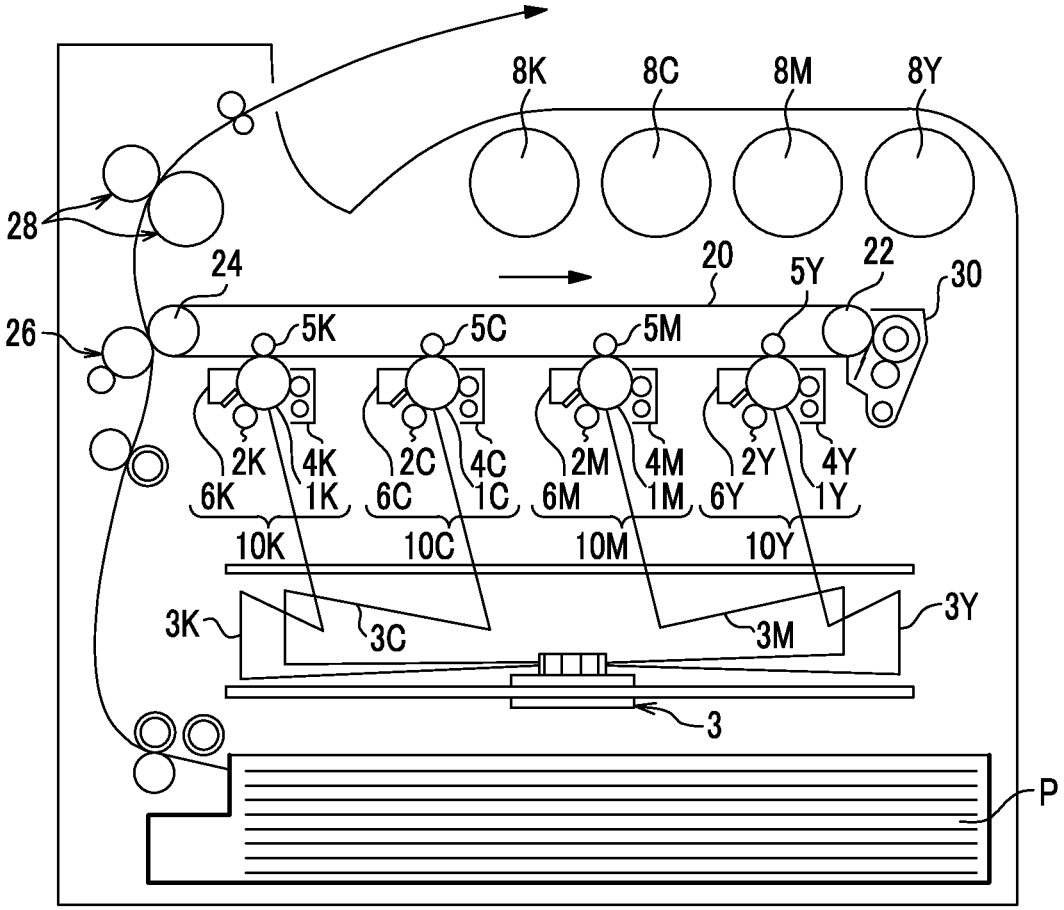
FIG. 1 is a diagram schematically illustrating a configuration of an example of an image forming apparatus according to an exemplary embodiment of the invention.

Hereinafter, an exemplary embodiment which is an example of the invention will be described in detail.

Electrostatic Charge Image Developing Carrier

An electrostatic charge image developing carrier (hereinafter, referred to simply as "carrier" in some cases) according to an exemplary embodiment of the invention includes:

core particle that has a BET specific surface area of from 0.05 $m^2/g$ to 0.10 $m^2/g$; and a resin coat layer on a surface of the core particle and contains a nitrogen-containing (meth)acrylate resin. "(Meth)acrylate" represents methacrylate or acrylate.

When an image is formed using a developer containing a resin-coated carrier in a high-temperature and high-humidity environment and in a low-temperature and low-humidity environment, the fluidity of the developer varies depending on the environment, the transport properties of toner varies accordingly, and the charge of toner is likely to broaden. As a result, image density unevenness may occur.

In general, in a high-temperature and high-humidity environment, the chargeability of a developer is low, and the image density is likely to be high. Therefore, an image forming apparatus decreases the toner concentration to adjust the chargeability of the developer to be high. On the other hand, in a low-temperature and low-humidity environment, the chargeability is likely to be high. When the environment changes from a high-temperature and high-humidity environment to a low-temperature and low-humidity environment, the image forming apparatus increases the toner concentration to adjust the chargeability to be low. At this time, it is considered that the fluidity of the developer does not keep up with the change in environment and the change in toner concentration, and the charge of toner is likely to broaden, and thus nonuniformity in image quality (density unevenness) is likely to occur.

In addition, in a trickle development system in which development is performed while replacing a carrier with a new carrier by supplying a small amount of carrier to a developer cartridge, replenishing the carrier and the toner and discharging a small amount of carrier from a developing unit, the carrier present in the developer cartridge may be nonuniformly mixed, and the amount of the carrier replenished to the developing unit varies. Therefore, during the supplying of the carrier, the charge of the toner is broad, and generation of image density unevenness may occur.

On the other hand, by using the carrier according to the exemplary embodiment, even when the environment changes from a high-temperature and high-humidity environment to a low-temperature and low-humidity environment, generation of image density unevenness is prevented. The reason is presumed to be as follows.

The carrier according to the exemplary embodiment includes core particle which are magnetic particle having a smooth surface in which a BET specific surface area is from 0.05 $m^2/g$ to 0.1 $m^2/g$. Therefore, high fluidity is obtained, and even when the environment or the toner concentration changes, a decrease in the fluidity of a developer is prevented.

In addition, since the specific surface area of the core particle is relatively small, the surfaces of the core particle are not likely to be exposed, and an effect of the resin coat layer is likely to be exhibited. Since a nitrogen-containing (meth)acrylate resin contained in the resin coat layer has a high charge imparting effect, a decrease in the chargeability of toner is prevented even in a high-temperature and high-humidity environment where the chargeability typically decreases. As a result, a variation in chargeability of toner depending on the environment is prevented.

An electric repulsion between carrier particles increases due to an increase in chargeability. Therefore, the fluidity is improved, and a variation in transport properties depending on the environment is prevented. As a result, nonuniformity in chargeability is not likely to occur, and thus generation of image density unevenness is prevented.

In addition, when core particle having a small BET specific surface area are coated with a resin, the exposure of the core particle is small as compared to a case where core particle having a large BET specific surface area is coated with a resin. Therefore, the charging effect of the resin coat layer is likely to be exhibited.

As a result, it is considered that generation of density unevenness is prevented.

In addition, it is considered that, even when the carrier according to the exemplary embodiment is replenished to a developing device using a trickle development system, the stirring property is excellent, a variation in chargeability depending on the environment is prevented, and generation of density unevenness is prevented.

Core Particle

The core particle of the carrier according to the exemplary embodiment has a BET specific surface area of from 0.05 $m^2/g$ to 0.10 $m^2/g$. The BET specific surface area of the core particle is a value measured using a nitrogen substitution method and, specifically, is measured using a specific surface area measuring device SA3100 (manufactured by Beckman Coulter Co., Ltd.).

From the viewpoint of preventing generation of image density unevenness when the environment (temperature and humidity) changes, the BET specific surface area of the core particle according to the exemplary embodiment is preferably from 0.06 $m^2/g$ to 0.09 $m^2/g$ and more preferably from 0.07 $m^2/g$ to 0.08 $m^2/g$.

Examples of the core particles according to the exemplary embodiment include magnetic metal particles (for example, particles of iron, steel, nickel, or cobalt) and magnetic oxide particles (for example, particles of ferrite or magnetite).

It is preferable that the core particles be ferrite particles represented by, for example, the following formula.

$$(MO)_X(Fe_2O_3)_Y \qquad \text{Formula:}$$

In the formula, Y represents 2.1 to 2.4, and X represents 3−Y. M represents a metal element and preferably contains at least Mn as the metal element.

M contains Mn as a major component and may further contain at least one element selected from the group consisting of Li, Ca, Sr, Sn, Cu, Zn, Ba, Mg, and Ti (preferably, the group consisting of Li, Ca, Sr, Mg, and Ti from the viewpoint of the environment).

The core particles are obtained by magnetic granulation or sintering, and as a pre-treatment, the magnetic materials may be pulverized. A pulverization method is not particularly limited. For example, a well-known pulverization method may be used, and specific examples thereof include methods using a mortar, a ball mill, and a jet mill.

A volume average particle diameter of the core particles is, for example, from 10 μm to 500 μm, and is preferably from 20 μm to 100 μm, more preferably from 25 μm to 60 μm, and particularly more preferably from 28 μm to 45 μm. When the volume average particle diameter of the core particles is from 28 μm to 45 μm, a high-quality image may be obtained.

The volume average particle diameter of the core particles according to the exemplary embodiment is measured as follows. The volume average particle diameter of the carrier is also measured as follows.

Using a laser scattering diffraction particle diameter distribution analyzer (LS particle size analyzer; manufactured by Beckman Coulter Co., Ltd.), a particle diameter distribution is measured. As an electrolytic solution, ISOTON-II (manufactured by Beckman Coulter Co., Ltd.) is used. The number of particles to be measured is 50,000.

Using the measured particle diameter distribution, a volume cumulative particle diameter distribution is drawn on divided particle diameter ranges (channels) from the smallest particle diameter size. A particle diameter having a cumulative value of 50% by volume (also referred to as "D50v") is defined as "volume average particle diameter".

Resin Coat Layer

The resin coat layer that coats at least a part of the surface of the core particle in the carrier according to the exemplary embodiment contains a nitrogen-containing (meth)acrylate resin as a coating resin.

Examples of the nitrogen-containing (meth)acrylate resin contained in the resin coat layer include polymers of (meth) acrylates containing nitrogen (nitrogen-containing (meth) acrylates) such as dimethylaminomethyl (meth)acrylate, dimethylaminoethyl (meth)acrylate, and dibutylaminomethyl (meth)acrylate; copolymers of nitrogen-containing (meth)acrylates and monomers not containing nitrogen; and copolymers of (meth)acrylates not containing nitrogen such as cycloalkyl (meth)acrylate and alkyl (meth)acrylates and monomers containing nitrogen (nitrogen-containing monomers). It is preferable that the nitrogen-containing (meth) acrylate resin has an amino group. In particular, a nitrogen-containing methacrylate resin is preferably used.

As the nitrogen-containing monomers, for example, a compound having an amide group, a compound having an amino group, and a compound having a maleimide structure may be used. Specific examples of the nitrogen-containing monomers include 2-vinylpyridine, 4-vinylpyridine, 2-vinyl-6-methylpyridine, 2-vinyl-5-methylpyridine, 4-butenylpyridine, 4-pentenylpyridine, N-vinylpiperidine, 4-vinylpiperidine, N-vinyldihydropyridine, N-vinylpyrrole, 2-vinylpyrrole, N-vinylpyrroline, N-vinylpyrrolidine, 2-vinylpyrrolidine, N-vinyl-2-pyrrolidone, N-vinyl-2-piperidone, N-vinylcarbazole, dimethylaminomethyl acrylate, dimethylaminomethyl methacrylate, dimethylaminoethyl acrylate, dimethylaminoethyl methacrylate, dibutylaminoethyl acrylate, dibutylaminomethyl methacrylate, N-cyclohexylmaleimide, and N-phenylmaleimide.

Examples of the monomers not containing nitrogen which may constitute a part of the nitrogen-containing (meth) acrylate resin include monoolefins such as ethylene, propylene, butylene, and isobutylene; vinyl esters such as vinyl acetate, vinyl propionate, vinyl benzoate, and vinyl butyrate; α-methylene aliphatic monocarboxylic acid esters such as methyl acrylate, phenyl acrylate, octyl acrylate, methyl methacrylate, ethyl methacrylate, butyl methacrylate, and dodecyl methacrylate; vinyl ethers such as vinyl methyl ether, vinyl ethyl ether, and vinyl butyl ether; and vinyl ketones such as vinyl methyl ketone, vinyl hexyl ketone, and vinyl isopropenyl ketone.

A weight average molecular weight of the nitrogen-containing (meth)acrylate resin is preferably from 50,000 to 140,000, more preferably from 60,000 to 130,000 and still more preferably from 70,000 to 120,000 when the molecular weight (in terms of polystyrene) is measured by gel permeation chromatography (GPC).

The resin coat layer may further contain other coating resins in addition to the nitrogen-containing (meth)acrylate resin. Examples of the other coating resins include acrylic resins, polyethylene resins, polypropylene resins, polystyrene resins, polyacrylonitrile resins, polyvinylacetate resins, polyvinylalcohol resins, polyvinylbutyral resins, polyvinyl chloride resins, polyvinyl carbazole resins, polyvinyl ether resins, polyvinyl ketone resins, vinyl chloride-vinyl acetate copolymers, styrene-acrylic acid copolymers, straight silicone resins having an organosiloxane bond and modified compounds thereof, fluororesins, polyester resins, polyurethane resins, polycarbonate resins, phenol resins, amino resins, melamine resins, benzoguanamine resins, urea resins, amide resins, and epoxy resins.

The content of the nitrogen-containing (meth)acrylate resin in the resin coat layer is preferably from 50% by weight to 100% by weight, more preferably 70% by weight to 100% by weight, and still more preferably 80% by weight to 100% by weight.

The resin coat layer may further contain resin particles for the purposes of charge control and the like, or may further contain conductive particles for the purposes of resistance control and the like. The resin coat layer may further contain other additives.

The resin particles are not particularly limited. For example, a charge-controlling material is preferable, and examples thereof include melamine resin particles, urea resin particles, urethane resin particles, polyester resin particles, and acrylic resin particles. Among these, melamine resins are preferably used from the viewpoint of dispersibility in a nitrogen-containing (meth)acrylic resin. A volume average particle diameter of the resin particles is preferably from 80 nm to 200 nm.

Examples of the conductive particles include carbon black particles, various metal powders, and metal oxide particles (for example, particles of titanium oxide, tin oxide, magnetite, and ferrite). Among these, one kind may be used alone, two or more kinds may be used in combination. Among these, carbon black particles are preferably used from the viewpoints of manufacturing stability, cost, conductivity, and the like. The kind of the carbon black is not particularly limited. For example, carbon black having a DBP absorption of, approximately, from 50 ml/100 g to 250 ml/100 g is preferably used from the viewpoint of manufacturing stability.

The electrostatic charge image developing carrier according to the exemplary embodiment satisfies the following expression:

$$4 \leq A \times B \leq 20$$

wherein A represents the volume average particle diameter (nm) of the resin particles, and B represents the BET specific surface area ($m^2/g$) of the core particle.

In the above-described range, the resin particles dispersed in the resin are likely to be well-arranged relative to the surface area of the core particle, and charging properties and the like are excellent, which is preferable. In particular, it is preferable that the expression be within a range of from 5 to 10.

The thickness of the resin coat layer in the carrier according to the exemplary embodiment is preferably from 0.1 μm to 10 μm and more preferably from 0.3 μm to 5 μm.

In addition, it is preferable that a coverage of the core particles covered with the resin coat layer is preferably from 80% to 98% and more preferably from 90% to 98%.

Here, the coverage of the core particle (ferrite particles) is measured as follows.

As an X-ray Photoelectron spectrometer, ESCA-9000MX (manufactured by JEOL Ltd.) is used, and the carrier is fixed to a sample holder and is inserted into a chamber of ESCA. The vacuum degree of the chamber is set to be $1\times10^{-6}$ Pa or lower, Mg-Kα is used as an excitation source, and the output is set to be 200 W. Under the above conditions, XPS spectra of the core particles and the carrier are measured, and a coverage is calculated from a ratio of integrated intensities of the detected elements at an Fe peak (2p3/2).

$$\text{Coverage}=F2/F1\times100$$

(F1: Fe integrated intensity of the core particles, F2: Fe integrated intensity of the carrier)

Examples of a method of forming the resin coat layer on the surfaces of the core particles include a wet method and a dry method. In the wet method, a solvent in which the coating resin of the resin coat layer is dissolved or dispersed is used. On the other hand, in the dry method, the solvent is not used.

Examples of the wet method include a dipping method in which the core particles are dipped in and coated with a resin coat layer-forming resin solution; a spray method in which a resin coat layer-forming resin solution is sprayed on the surfaces of the core particles; a fluidized bed method in which a resin coat layer-forming resin solution is sprayed on the core particle while fluidizing the core particles in a fluidized bed; and a kneader coater method in which the core particles and a resin coat layer-forming resin solution are mixed in a kneader coater, and then a solvent is removed.

Examples of the dry method include a method in which a mixture of the core particles and a resin coat layer-forming material is heated in a dry state to form the resin coat layer. Specifically, for example, the core particles and the resin coat layer-forming material are mixed in a gas phase, and the mixture is heated and melted to form the resin coat layer.

The amount of the resin coat layer with which the core particles are coated is, for example, 0.5% by weight or more, preferably from 0.7% by weight to 6% by weight, and more preferably from 1.0% by weight to 5.0% by weight, with respect to the total weight of the carrier.

In order to coat the surfaces of the core particles with the coating resin, for example, a method is used in which the surfaces of the core particles are coated with a resin coat layer-forming solution obtained by dissolving or dispersing the coating resin and optionally various additives in an appropriate solvent. The solvent is not particularly limited and may be selected in consideration of the coating resin to be used, coating suitability, and the like.

Specific examples of the resin coating method include a dipping method in which the core particles are dipped in a resin coat layer-forming solution; a spray method in which a resin coat layer-forming solution is sprayed on the surfaces of the core particles; a fluidized bed method in which a resin coat layer-forming solution is sprayed on the core particle while floating the core particles with flowing air; and a kneader coater method in which the core particles and a resin coat layer-forming solution are mixed in a kneader coater, and then a solvent is removed.

A volume average particle diameter of the carrier is, for example, from 20 μm to 200 and is preferably from 25 μm to 60 μm and more preferably from 28 μm to 45 μm.

An electrostatic charge image developer (hereinafter, also referred to as "developer") according to the exemplary embodiment contains an electrostatic charge image developing toner and the above-described electrostatic charge image developing carrier.

The toner contained in the developer according to the exemplary embodiment contains toner particles and optionally further contains an external additive.

(Toner Particles)

The toner particles contains, for example, a binder resin and optionally further contains a colorant, a release agent, and other additives.

Binder Resin

Examples of the binder resin include vinyl resins made of a homopolymer of one monomer or copolymers of two or more monomers selected from the following monomers: styrenes (for example, styrene, parachlorostyrene, and α-methylstyrene); (meth)acrylates (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate); ethylenically unsaturated nitriles (for example, acrylonitrile and methacrylonitrile); vinyl ethers (for example, vinyl methyl ether and vinyl isobutyl ether); vinyl ketones (vinyl methyl ketone, vinyl ethyl ketone, and vinyl isopropenyl ketone); and olefins (for example, ethylene, propylene, and butadiene).

Examples of the binder resin include non-vinyl resins such as epoxy resins, polyester resins, polyurethane resins, polyamide resins, cellulose resins, polyether resins, and modified rosins; mixtures of the non-vinyl resins and the vinyl resins; and graft polymers obtained by polymerization of vinyl monomers in the presence of the non-vinyl resins.

Among these binder resins, one kind may be used alone, two or more kinds may be used in combination.

The content of the binder resin is, for example, preferably from 40% by weight to 95% by weight, more preferably from 50% by weight to 90% by weight, and still more preferably from 60% by weight to 85% by weight with respect to the total weight of the toner particles.

Colorant

Examples of the colorant include various kinds of pigments such as carbon black, chrome yellow, Hansa Yellow, Benzidine Yellow, Threne Yellow, Quinoline Yellow, Pigment Yellow, Permanent Orange GTR, Pyrazolone Orange, Vulcan Orange, Watchung Red, Permanent Red, Brilliant Carmine 3B, Brilliant Carmine 6B, Du Pont Oil Red, Pyrazolone Red, Lithol Red, Rhodamine B Lake, Lake Red C, Pigment Red, Rose Bengal, Aniline Blue, Ultramarine Blue, Calco Oil Blue, Methylene Blue Chloride, Phthalocyanine Blue, Pigment Blue, Phthalocyanine Green, and Malachite Green Oxalate; and various dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

Among these colorants, one kind may be used alone, two or more kinds may be used in combination.

Optionally, the colorant may be surface-treated, or may be used in combination with a dispersant. In addition, plural kinds of colorants may be used in combination.

The content of the colorant is, for example, preferably from 1% by weight to 30% by weight and more preferably from 3% by weight to 15% by weight with respect to the total weight of the toner particles.

Release Agent

Examples of the release agent include hydrocarbon waxes; natural waxes such as carnauba wax, rice wax, and candelilla wax; synthetic or mineral and petroleum waxes such as montan wax; and ester waxes such as fatty acid ester and montanic acid ester. The release agent is not limited to these examples.

The melting temperature of the release agent is preferably from 50° C. to 110° C. and more preferably from 60° C. to 100° C.

The melting temperature is calculated from the DSC curve obtained from differential scanning calorimetry (DSC) according to a "melting peak temperature" described in a method of calculating melting temperature in "Testing methods for transition temperatures of plastics" of JIS K-1987.

The content of the release agent is, for example, preferably from 1% by weight to 20% by weight and more preferably from 5% by weight to 15% by weight with respect to the total weight of the toner particles.

Other Additives

Examples of the other additives include various additives such as a magnetic material, a charge-controlling agent, and inorganic powder. These additives are contained in the toner particles as internal additives.

Properties of Toner Particles

The toner particles may have a single-layer structure or a so-called core-shell structure including: a core (core particle) and a coating layer (shell layer) that coats the core.

Here, it is preferable that the toner particles having a core-shell structure include: a core that contains a binder resin and optionally further contains other additives such as a colorant and a release agent; and a coating layer that contains a binder resin.

The volume average particle diameter (D50v) of the toner particles is preferably from 2 μm to 10 μm and more preferably 4 μm to 8 μm.

Various average particle diameters and various particle diameter distribution indices of the toner particles are measured by using COULTER MULTISIZER II (manufactured by Beckman Coulter Co., Ltd.) as a measuring device and using ISOTON-II (manufactured by Beckman Coulter Co., Ltd.) as an electrolytic solution.

During this measurement, from 0.5 mg to 50 mg of a measurement sample is added to 2 ml of an aqueous solution containing 5% of a surfactant (preferably, sodium alkylbenzene sulfonate) as a dispersant. This solution is added to from 100 ml to 150 ml of the electrolytic solution.

The electrolytic solution in which the measurement sample is suspended is dispersed with an ultrasonic disperser for 1 minute. Then, a particle diameter distribution of particles having a particle diameter in a range of 2.0 μm to 60 μm is measured using COULTER MULTISIZER II and an aperture having an aperture diameter of 100 μm. The number of particles to be sampled is 50,000.

Volume and number cumulative particle diameter distributions are drawn on particle diameter ranges (channels) divided based on the measured particle diameter distribution from the smallest particle diameter side. In addition, particle diameters having cumulative values of 16% by volume and number are defined as a volume particle diameter D16v and a number particle diameter D16p, respectively. Particle diameters having cumulative values of 50% by volume and number are defined as a volume average particle diameter D50v and a number average particle diameter D50p, respectively. Particle diameters having cumulative values of 84% by volume and number are defined as a volume particle diameter D84v and a number particle diameter D84p, respectively.

Using these values, a volume average particle diameter distribution index (GSDv) is calculated from $(D84v/D16v)^{1/2}$, and a number average particle diameter distribution index (GSDp) is calculated from $(D84p/D16p)^{1/2}$.

The shape factor SF1 of the toner particles is preferably from 110 to 150 and more preferably from 120 to 140.

The shape factor SF1 is obtained from the following expression.

$$SF1=(ML^2/A)\times(\pi/4)\times 100 \qquad \text{Expression:}$$

In the expression' ML represents an absolute maximum length of a toner particle, and A represents a projected area of a toner particle.

Specifically, the shape factor SF1 is converted to a numerical value by analyzing a microscopic image or a scanning electron microscope (SEM) image using an image analyzer and calculated as follows. That is, an optical microscope image of particles sprayed on a glass slide surface is input to an image analyzer LUZEX through a video camera, maximum lengths and projected areas of 100 particles are obtained to calculate shape factors thereof from the above expression, and an average value thereof is obtained.

External Additive

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.Sio_2$, $K_2O.(TiO_2)n$, $Al_2O_3.2SiO_2$, $CaCO_3$, $MgCO_3$, $BaSO_4$, and $MgSO_4$.

Surfaces of the inorganic particles as the external additive may be treated with a hydrophobizing agent. The treatment with hydrophobizing agent may be performed, for example, by dipping the inorganic particles in a hydrophobizing agent. The hydrophobizing agent is not particularly limited, and examples thereof include a silane coupling agent, silicone oil, a titanate coupling agent, and an aluminum coupling agent. Among these, one kind may be used alone, two or more kinds may be used in combination.

The amount of the hydrophobizing agent is from 1 part by weight to 10 parts by weight with respect to 100 parts by weight of the inorganic particles.

Examples of the external additive include resin particles (for example, resin particles of polystyrene, polymethyl methacrylate (PMMA), and melamine resin) and a cleaning aid (for example, particles of metal salts of higher fatty acids such as zinc stearate and fluorine polymers).

The amount of the external additive to be externally added is, for example, preferably from 0.01% by weight to 5% by weight and more preferably from 0.01% by weight to 2.0% by weight with respect to the toner particles.

Method of Preparing Toner

Next, a method of preparing a toner according to the exemplary embodiment will be described.

The toner according to the exemplary embodiment is obtained by preparing the toner particles and externally adding the external additive to the toner particles.

The toner particles may be prepared using either a dry method (for example, a kneading and pulverizing method) or a wet method (for example, an aggregation and coalescence method, a suspension polymerization method, or a dissolution suspension method). The method of preparing the toner particles is not limited to these methods, and a well-known method is adopted.

Among these, an aggregation and coalescence method is preferably used to obtain the toner particles.

The toner according to the exemplary embodiment is prepared, for example, by adding the external additive to the obtained dry toner particles and mixing them with each other. It is preferable that the mixing be performed using a V blender, a HENSCHEL mixer, or a LÖDIGE mixer. Further optionally, coarse particles of the toner may be removed, for example, using a vibration sieve or a wind classifier.

A mixing ratio (weight ratio; toner:carrier) of the toner to the carrier in the developer according to the exemplary embodiment is preferably 1:100 to 30:100 and more preferably 3:100 to 20:100.

Image Forming Apparatus and Image Forming Method

An image forming apparatus and an image forming method according to the exemplary embodiment will be described.

The image forming apparatus according to the exemplary embodiment includes: an image holding member; a charging unit that charges a surface of the image holding member; an electrostatic charge image forming unit that forms an electrostatic charge image on a charged surface of the image holding member; a developing unit that accommodates an electrostatic charge image developer and develops the electrostatic charge image, which is formed on the surface of the image holding member, using the electrostatic charge image developer to form a toner image on the surface of the image holding member; a transfer unit that transfers the toner image, which is formed on the surface of the image holding member, to a surface of a recording medium; and a fixing unit that fixes the toner image transferred onto the surface of the recording medium. As the electrostatic charge image developer, the electrostatic charge image developer according to the exemplary embodiment is used.

In the image forming apparatus according to the exemplary embodiment, an image forming method (image forming method according to the exemplary embodiment) is performed, the method including: a charging step of charging a surface of an image holding member; an electrostatic charge image forming step of forming an electrostatic charge image on a charged surface of the image holding member; a developing step of developing the electrostatic charge image, which is formed on the surface of the image holding member, using the electrostatic charge image developer according to the exemplary embodiment to form a toner image on the surface of the image holding member; a transfer step of transferring the toner image, which is formed on the surface of the image holding member, to a surface of a recording medium; and a fixing step of fixing the toner image transferred onto the surface of the recording medium.

As the image forming apparatus according to the exemplary embodiment, various well-known image forming apparatuses may be used, the apparatuses including: a direct transfer type apparatus in which a toner image formed on a surface of an image holding member is directly transferred to a recording medium; an intermediate transfer type apparatus in which a toner image formed on a surface of an image holding member is primarily transferred to a surface of an intermediate transfer member, and the toner image transferred to the surface of the intermediate transfer member is secondarily transferred to a surface of a recording medium; an apparatus including a cleaning unit that cleans a surface of an image holding member after a toner image is transferred and before charging; and an apparatus including an erasing unit that irradiates a surface of an image holding member with erasing light to perform erasing after a toner image is transferred and before charging.

In the intermediate transfer type apparatus, for example, a transfer unit includes: an intermediate transfer member having a surface to which a toner image is transferred; a primary transfer unit that primarily transfers a toner image, which is formed on a surface of an image holding member, to the surface of the intermediate transfer member; and a secondary transfer unit that secondarily transfers the toner image, which is transferred to the surface of the intermediate transfer member, to a surface of a recording medium.

In the image forming apparatus according to the exemplary embodiment, for example, a portion including the developing unit may have a cartridge structure (process cartridge) which is detachable from the image forming apparatus. As the process cartridge, a process cartridge that accommodates the electrostatic charge image developer according to the exemplary embodiment and includes the developing unit is preferably used.

Hereinafter, an example of the image forming apparatus according to the exemplary embodiment will be described, but the image forming apparatus is not limited thereto. Major components illustrated in the drawings will be described, and the other components will not be described.

FIG. 1 is a diagram schematically illustrating a configuration of the image forming apparatus according to the exemplary embodiment.

The image forming apparatus illustrated in FIG. 1, includes first to fourth electrophotographic image forming units 10Y, 10M, 10C, and 10K (image forming units) that output images of the respective colors including yellow (Y), magenta (M), cyan (C), and black (K) based on color-separated image data. These image forming units (hereinafter, also simply referred to as "units") 10Y, 10M, 10C, and 10K are horizontally arranged in parallel at predetermined intervals. These units 10Y, 10M, 10C, and 10K may be process cartridges which are detachable from the image forming apparatus.

An intermediate transfer belt 20 which is the intermediate transfer member extends through a region above the respective units 10Y, 10M, 10C, and 10K in the drawing. The intermediate transfer belt 20 is wound around a drive roll 22 and a support roll 24 in contact with the inner surface of the intermediate transfer belt 20, which are arranged to be away from each other in a direction from the left to the right in the drawing. The intermediate transfer belt 20 travels in a direction from the first unit 10Y to the fourth unit 10K. A force is applied to the support roll 24 by a spring or the like (not illustrated) in a direction away from the drive roll 22, and a tension is applied to the intermediate transfer belt 20 wound around the drive roll 22 and the support roll 24. In addition, an intermediate transfer member cleaning device 30 is provided on an image holding member-side surface of the intermediate transfer belt 20 to be opposite to the drive roll 22.

In addition, toners of four colors including yellow, magenta, cyan, and black which are accommodated in toner cartridges 8Y, 8M, 8C, and 8K are supplied to developing devices (developing units) 4Y, 4M, 4C, and 4K of the respective units 10Y, 10M, 10C, and 10K, respectively.

Since the first to fourth units 10Y, 10M, 10C, and 10K have the same configuration, the first unit 10Y which is arranged on an upstream side in the traveling direction of the intermediate transfer belt and forms a yellow image will be described as a representative example. The same components as those of the first unit 10Y are represented by reference numerals to which the symbols M (magenta), C (cyan), and K (black) are attached instead of the symbol Y (yellow), and the second to fourth units 10M, 10C, and 10K, will not be described.

The first unit 10Y includes a photoreceptor 1Y which functions as the image holding member. Around the photoreceptor 1Y, a charging roll 2Y (an example of the charging unit) that charges a surface of the photoreceptor 1Y to a predetermined potential; an exposure device 3 (an example of the electrostatic charge image forming unit) that exposes a charged surface to a laser beam 3Y based on a color-separated image signal to form an electrostatic charge image thereon; a developing device (an example of the developing unit) 4Y that supplies a charged toner to the electrostatic charge image to develop the electrostatic charge image; a primary transfer roll 5Y (an example of the primary transfer unit) that transfers the developed toner image to the intermediate transfer belt 20; and a photoreceptor cleaning device 6Y (an example of the cleaning unit) that removes the toner remaining on the surface of the photoreceptor 1Y after the primary transfer, are arranged sequentially.

The primary transfer roll 5Y is arranged inside the intermediate transfer belt 20 and is provided at a position opposite to the photoreceptor 1Y. Further, bias power supplies (not illustrated) are connected to the primary transfer rolls 5Y, 5M, 5C, and 5K to apply primary transfer biases thereto. A controller (not illustrated) controls the respective bias power supplies to change the transfer biases which are applied to the respective primary transfer rolls.

Hereinafter, the operation of forming the yellow image in the first unit 10Y will be described.

First, before the operation, the surface of the photoreceptor 1Y is charged to a potential of −600 V to −800 V by the charging roll 2Y.

The photoreceptor 1Y is formed by laminating a photosensitive layer on a conductive substrate (for example, volume resistivity at 20° C.: $1\times10^{-6}$ Ωcm or lower). This photosensitive layer typically has high resistance (resistance of a general resin) but has a property in which, when being irradiated with the laser beam 3Y, the specific resistance of the portion irradiated with the laser beam changes. Therefore, the charged surface of the photoreceptor 1Y is irradiated with the laser beam 3Y through the exposure device 3 according to image data for yellow sent from the controller (not illustrated). The photosensitive layer of the surface of the photoreceptor 1Y is irradiated with the laser beam 3Y, and thus an electrostatic charge image of a yellow image pattern is formed on the surface of the photoreceptor 1Y.

The electrostatic charge image is an image which is formed on the surface of the photoreceptor 1Y by charging and is a so-called negative latent image which is formed when the specific resistance of a portion, which is irradiated with the laser beam 3Y, of the photosensitive layer is reduced and the charged charge flows on the surface of the photoreceptor 1Y, and when the charge remains in a portion which is not irradiated with the laser beam 3Y.

The electrostatic charge image formed on the photoreceptor 1Y is rotated to a predetermined development position along with the travelling of the photoreceptor 1Y. At this development position, the electrostatic charge image on the photoreceptor 1Y is visualized (developed) as a toner image by the developing device 4Y.

The developing device 4Y accommodates, for example, an electrostatic charge image developer containing at least a yellow toner and the carrier according to the exemplary embodiment. The yellow toner is frictionally charged by being agitated in the developing device 4Y to have a charge having the same polarity (negative polarity) as that of a charge charged on the photoreceptor 1Y and is maintained on a developer roll (an example of the developer holding member). When the surface of the photoreceptor 1Y passes through the developing device 4Y, the yellow toner is electrostatically attached to a latent image portion having been erased on the surface of the photoreceptor 1Y, and the latent image is developed with the yellow toner. The photoreceptor 1Y on which a yellow toner image is formed continuously travels at a predetermined rate, and the toner image developed on the photoreceptor 1Y is transported to a predetermined primary transfer position.

When the yellow toner image on the photoreceptor 1Y is transported to the primary transfer position, a primary transfer bias is applied to the primary transfer roll 5Y, an electrostatic force from the photoreceptor 1Y to the primary transfer roll 5Y acts on the toner image, and the toner image on the photoreceptor 1Y is transferred to the intermediate transfer belt 20. The transfer bias applied at this time has a positive polarity opposite to the negative polarity of the toner. For example, in the first unit 10Y, it is controlled to +10 μA by the controller (not shown).

On the other hand, the toner remaining on the photoreceptor 1Y is removed and collected by the photoreceptor cleaning device 6Y.

In addition, primary transfer biases which are applied to the primary transfer rolls 5M, 5C and 5K of the second unit 10M and subsequent units, respectively, are controlled in a similar way to that of the primary transfer bias of the first unit.

In this way, the intermediate transfer belt 20 to which the yellow toner image is transferred by the first unit 10Y is sequentially transported through the second to fourth units 10M, 10C and 10K, and toner images of the respective colors are superimposed and multi-transferred.

The intermediate transfer belt 20 to which the four color toner images are multi-transferred by the first to fourth units reaches a secondary transfer portion which is configured with the intermediate transfer belt 20, the support roll 24, and a secondary transfer roll 26 (an example of the secondary transfer unit), in which the support roll 24 contacts with the inner surface of the intermediate transfer belt, and the secondary transfer roll 26 is arranged on an image holding surface side of the intermediate transfer belt 20. Meanwhile, a recording sheet P (an example of the recording medium) is supplied to a gap at which the secondary transfer roll 26 and the intermediate transfer belt 20 contact with each other at a predetermined timing through a supply mechanism, and a secondary transfer bias is applied to the support roll 24. The transfer bias applied at this time has the negative polarity which is the same as the polarity of the toner, and an electrostatic force from the intermediate transfer belt 20 to the recording sheet P acts on the toner image. As a result, the toner image on the intermediate transfer belt 20 is transferred to the recording sheet P. At this time, the secondary transfer bias is determined depending on a resistance detected by a resistance detecting unit (not illustrated) which detects a resistance of the secondary transfer portion, and the voltage is controlled.

Thereafter, the recording sheet P is fed to a press-contact portion (nip portion) of a pair of fixing rolls in a fixing device 28 (an example of the fixing unit), and the toner image is fixed onto the recording sheet P to form a fixed image.

Examples of the recording sheet P to which the toner image is transferred include plain paper used for electrophotographic copying machines, printers and the like. As the recording medium, in addition to the recording sheet P, OHP sheets may be used.

In order to further improve the smoothness of the image surface after the fixing, the surface of the recording sheet P is preferably smooth, and for example, coated paper obtained by coating the surface of plain paper with a resin or the like, or art paper for printing is suitably used.

The recording sheet P onto which a color image is completely fixed is discharged to an exit port, and a series of the color image formation operations ends.

Process Cartridge and Developer Cartridge

A process cartridge according to the exemplary embodiment will be described.

A process cartridge according to the exemplary embodiment is detachable from an image forming apparatus and includes: a developing unit that accommodates the electrostatic charge image developer according to the exemplary embodiment and develops an electrostatic charge image, which is formed on a surface of an image holding member, using the electrostatic charge image developer to form a toner image.

In addition, the process cartridge according to the exemplary embodiment is not limited to the above-described configuration, and may include the developing device and optionally at least one component selected from other units such as an image holding member, a charging unit, an electrostatic charge image forming unit, and a transfer unit.

Hereinafter, an example of the process cartridge according to the exemplary embodiment will be described, but the process cartridge is not limited thereto. Major components illustrated in the drawings will be described, and the other components will not be described.

Figure 2:
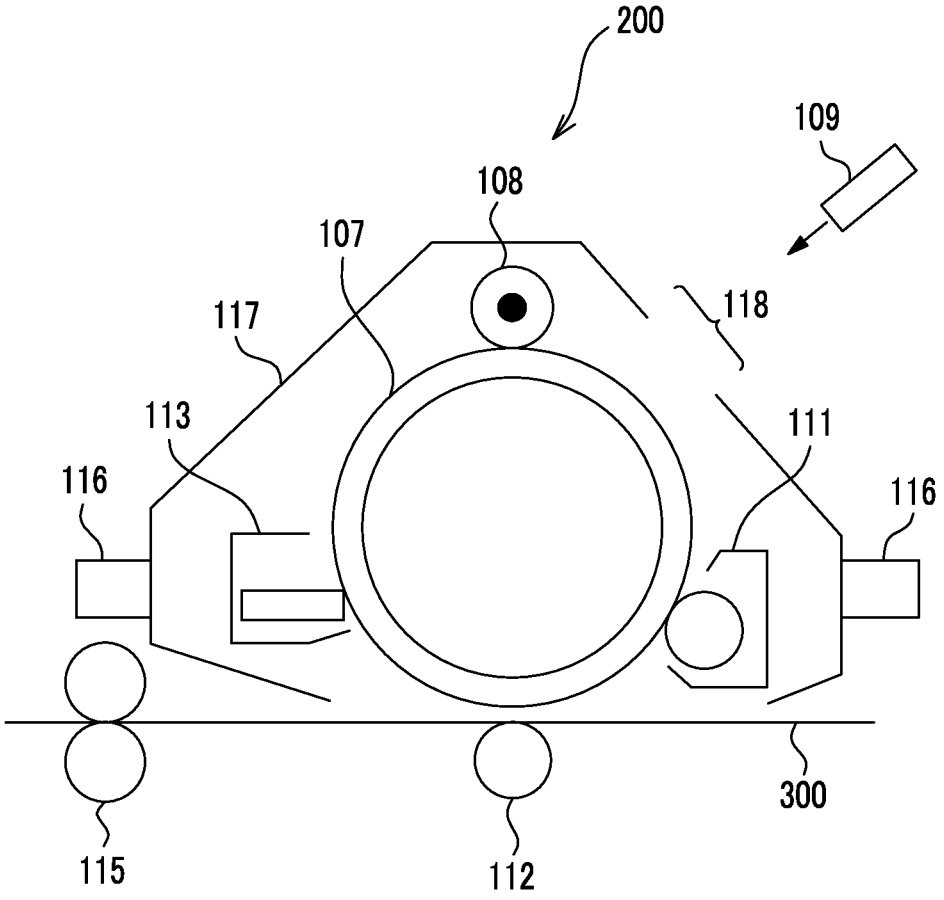
FIG. 2 is a diagram schematically illustrating a configuration of an example of a process cartridge according to an exemplary embodiment of the invention.

FIG. 2 is a diagram schematically illustrating a configuration of the process cartridge according to the exemplary embodiment.

A process cartridge 200 illustrated in FIG. 2 is, for example, a cartridge in which a photoreceptor 107 (an example of the image holding member), and a charging roll 108 (an example of the charging unit), a developing device 111 (an example of the developing unit), and a photoreceptor cleaning device 113 (an example of the cleaning unit) provided around the photoreceptor 107, are integrally combined in a housing 117 including a mounting rail 116 and an opening 118 for exposure.

In FIG. 2, reference numeral 109 represents an exposure device (an example of the electrostatic charge image forming unit), reference numeral 112 represents a transfer device (an example of the transfer unit), reference numeral 115 represents a fixing device (an example of the fixing unit), and reference numeral 300 represents a recording sheet (an example of the recording medium).

Next, a developer cartridge according to the exemplary embodiment will be described.

The developer cartridge according to the exemplary embodiment includes a container that accommodates the developer according to the exemplary embodiment and is detachable from an image forming apparatus.

The carrier according to the exemplary embodiment may be suitably used as a developing carrier in a so-called trickle development system in which development is performed while replacing a carrier accommodated in a developing unit with a new carrier. For example, in the image forming apparatus illustrated in FIG. 1, the developer is supplied to the developing devices 4Y, 4M, 4C, and 4K by using the toner cartridges 8Y, 8M, 8C, and 8K as the developer cartridges according to the exemplary embodiment, and the trickle development system may be used in which development is performed while replacing the electrostatic charge image developing carrier, which is accommodated in the developing devices 4Y, 4M, 4C, and 4K, with a new carrier.

Regarding an amount of the carrier according to the exemplary embodiment in the developer which is contained in the developer cartridge, as the amount of the carrier increases, a variation in the amount of the carrier replenished to the developing device increases. Therefore, the amount is preferably 20% by weight or less and more preferably from 1% by weight to 10% by weight with respect to the amount of the toner.

A cartridge which accommodates toner for replenishment alone and a cartridge which accommodates the carrier according to the exemplary embodiment alone may be separately provided.

Examples

Hereinafter, the exemplary embodiment will be described in more detail using Examples and Comparative Examples but is not limited to these examples. Unless specified otherwise, "part(s)" and "%" represent "part(s) by weight" and "% by weight".

Measurement of BET Specific Surface Area of Core Particle

In order to prepare the following carrier, ferrite particles are used as core particles. A BET specific surface area of the ferrite particles is measured using a specific surface area measuring device SA3100 (manufactured by Beckman Coulter Co., Ltd.). Measurement conditions are as follows.

The measurement is performed with a three-point method using a specific surface area measuring device SA3100 (manufactured by Beckman Coulter Co., Ltd.,). 5 g of the core particles are put into a cell, followed by deaeration at 60° C. for 120 minutes. Then, the measurement is performed using mixed gas of nitrogen and helium (volume ratio=30:70).

Preparation of Carrier 1

Ferrite particles (Mn—Mg ferrite manufactured by Powdertech Co., Ltd., BET specific surface area: 0.07 $m^2/g$, volume average particle diameter: 36 μm): 100 parts Toluene: 15 parts Dimethylaminoethyl methacrylate polymer (weight average molecular weight: 100000): 3.0 parts Resin particles (melamine resin particles, volume average particle diameter: 100 nm): 0.30 parts The above-described components other than the ferrite particles are dispersed for three minutes using a homo-mixer to prepare a resin coat layer-forming solution. This solution and the ferrite particles are stirred for 15 minutes in a vacuum deairing type kneader held at 60° C. Next, toluene is removed by distillation for 15 minutes under a reduced pressure of 5 kPa, and Carrier 1 in which a resin coat layer is formed on surfaces of the ferrite particles is obtained.

Preparation of Carrier 2

Ferrite particles (Mn—Mg ferrite manufactured by Powdertech Co., Ltd., BET specific surface area: 0.05 $m^2/g$, volume average particle diameter: 36 μm): 100 parts Toluene: 15 parts Dimethylaminoethyl methacrylate polymer (weight average molecular weight: 100000): 3.0 parts Resin particles (melamine resin particles, volume average particle diameter: 100 nm): 0.30 parts The above-described components other than the ferrite particles are dispersed for three minutes using a homo-mixer to prepare a resin coat layer-forming solution. This solution and the ferrite particles are stirred for 15 minutes in a vacuum deairing type kneader held at 60° C. Next, toluene is removed by distillation for 15 minutes under a reduced pressure of 5 kPa, and Carrier 2 in which a resin coat layer is formed on surfaces of the ferrite particles is obtained.

Preparation of Carrier 3

Ferrite particles (Mn—Mg ferrite manufactured by Powdertech Co., Ltd., BET specific surface area: 0.09 $m^2/g$, volume average particle diameter: 36 μm): 100 parts Toluene: 15 parts Dimethylaminoethyl methacrylate polymer (weight average molecular weight: 100000): 3.0 parts Resin particles (melamine resin particles, volume average particle diameter: 100 nm): 0.30 parts The above-described components other than the ferrite particles are dispersed for three minutes using a homo-mixer to prepare a resin coat layer-forming solution. This solution and the ferrite particles are stirred for 15 minutes in a vacuum deairing type kneader held at 60° C. Next, toluene is removed by distillation for 15 minutes under a reduced pressure of 5 kPa, and Carrier 3 in which a resin coat layer is formed on surfaces of the ferrite particles is obtained.

Preparation of Carrier 4

Ferrite particles (Mn—Mg ferrite manufactured by Powdertech Co., Ltd., BET specific surface area: 0.07 $m^2/g$, volume average particle diameter: 36 μm): 100 parts Toluene: 15 parts Styrene-methyl methacrylate copolymer (weight average molecular weight: 100000): 3.0 parts Resin particles (melamine resin particles, volume average particle diameter: 100 nm): 0.30 parts The above-described components other than the ferrite particles are dispersed for three minutes using a homo-mixer to prepare a resin coat layer-forming solution. This solution and the ferrite particles are stirred for 15 minutes in a vacuum deairing type kneader held at 60° C. Next, toluene is removed by distillation for 15 minutes under a reduced pressure of 5 kPa, and Carrier 4 in which a resin coat layer is formed on surfaces of the ferrite particles is obtained.

Preparation of Carrier 5

Ferrite particles (Mn—Mg ferrite manufactured by Powdertech Co., Ltd., BET specific surface area: 0.15 $m^2/g$, volume average particle diameter: 36 μm): 100 parts Toluene: 15 parts Dimethylaminoethyl methacrylate polymer (weight average molecular weight: 100000): 3.0 parts Resin particles (melamine resin particles, volume average particle diameter: 100 nm): 0.30 parts The above-described components other than the ferrite particles are dispersed for three minutes using a homo-mixer to prepare a resin coat layer-forming solution. This solution and the ferrite particles are stirred for 15 minutes in a vacuum deairing type kneader held at 60° C. Next, toluene is removed by distillation for 15 minutes under a reduced pressure of 5 kPa, and Carrier 5 in which a resin coat layer is formed on surfaces of the ferrite particles is obtained.

Preparation of Carrier 6

Ferrite particles (Mn—Mg ferrite manufactured by Powdertech Co., Ltd., BET specific surface area: 0.07 $m^2/g$, volume average particle diameter: 36 μm): 100 parts Toluene: 15 parts Acryloylmorpholine polymer (weight average molecular weight: 100000): 3.0 parts Resin particles (melamine resin particles, volume average particle diameter: 100 nm): 0.30 parts The above-described components other than the ferrite particles are dispersed for three minutes using a homo-mixer to prepare a resin coat layer-forming solution. This solution and the ferrite particles are stirred for 15 minutes in a vacuum deairing type kneader held at 60° C. Next, toluene is removed by distillation for 15 minutes under a reduced pressure of 5 kPa, and Carrier 6 in which a resin coat layer is formed on surfaces of the ferrite particles is obtained.

Preparation of Carrier 7

Ferrite particles (Mn—Mg ferrite manufactured by Powdertech Co., Ltd., BET specific surface area: 0.07 $m^2/g$, volume average particle diameter: 20 μm): 100 parts Toluene: 15 parts Dimethylaminoethyl methacrylate polymer (weight average molecular weight: 100000): 3.0 parts Resin particles (melamine resin particles, volume average particle diameter: 100 nm): 0.30 parts The above-described components other than the ferrite particles are dispersed for three minutes using a homo-mixer to prepare a resin coat layer-forming solution. This solution and the ferrite particles are stirred for 15 minutes in a vacuum deairing type kneader held at 60° C. Next, toluene is removed by distillation for 15 minutes under a reduced pressure of 5 kPa, and Carrier 7 in which a resin coat layer is formed on surfaces of the ferrite particles is obtained.

Preparation of Carrier 8

Ferrite particles (Mn—Mg ferrite manufactured by Powdertech Co., Ltd., BET specific surface area: 0.07 $m^2/g$, volume average particle diameter: 52 μm): 100 parts Toluene: 15 parts Dimethylaminoethyl methacrylate polymer (weight average molecular weight: 100000): 3.0 parts Resin particles (melamine resin particles, volume average particle diameter: 100 nm): 0.30 parts The above-described components other than the ferrite particles are dispersed for three minutes using a homo-mixer to prepare a resin coat layer-forming solution. This solution and the ferrite particles are stirred for 15 minutes in a vacuum deairing type kneader held at 60° C. Next, toluene is removed by distillation for 15 minutes under a reduced pressure of 5 kPa, and Carrier 8 in which a resin coat layer is formed on surfaces of the ferrite particles is obtained.

Preparation of Carrier 9

Ferrite particles (Mn—Mg ferrite manufactured by Powdertech Co., Ltd., BET specific surface area: 0.07 $m^2/g$, volume average particle diameter: 27.5 μm): 100 parts Toluene: 15 parts Dimethylaminoethyl methacrylate polymer (weight average molecular weight: 100000): 3.0 parts Resin particles (melamine resin particles, volume average particle diameter: 100 nm): 0.30 parts The above-described components other than the ferrite particles are dispersed for three minutes using a homo-mixer to prepare a resin coat layer-forming solution. This solution and the ferrite particles are stirred for 15 minutes in a vacuum deairing type kneader held at 60° C. Next, toluene is removed by distillation for 15 minutes under a reduced pressure of 5 kPa, and Carrier 9 in which a resin coat layer is formed on surfaces of the ferrite particles is obtained.

Preparation of Carrier 10

Ferrite particles (Mn—Mg ferrite manufactured by Powdertech Co., Ltd., BET specific surface area: 0.07 $m^2/g$, volume average particle diameter: 44.5 μm): 100 parts Toluene: 15 parts Dimethylaminoethyl methacrylate polymer (weight average molecular weight: 100000): 3.0 parts Resin particles (melamine resin particles, volume average particle diameter: 100 nm): 0.30 parts The above-described components other than the ferrite particles are dispersed for three minutes using a homo-mixer to prepare a resin coat layer-forming solution. This solution and the ferrite particles are stirred for 15 minutes in a vacuum deairing type kneader held at 60° C. Next, toluene is removed by distillation for 15 minutes under a reduced pressure of 5 kPa, and Carrier 10 in which a resin coat layer is formed on surfaces of the ferrite particles is obtained.

Preparation of Carrier 11

Ferrite particles (Mn—Mg ferrite manufactured by Powdertech Co., Ltd., BET specific surface area: 0.07 $m^2/g$, volume average particle diameter: 36 μm): 100 parts Toluene: 15 parts Dimethylaminopropyl acrylate polymer (weight average molecular weight: 100000): 3.0 parts Resin particles (melamine resin particles, volume average particle diameter: 100 nm): 0.30 parts The above-described components other than the ferrite particles are dispersed for three minutes using a homo-mixer to prepare a resin coat layer-forming solution. This solution and the ferrite particles are stirred for 15 minutes in a vacuum deairing type kneader held at 60° C. Next, toluene is removed by distillation for 15 minutes under a reduced pressure of 5 kPa, and Carrier 11 in which a resin coat layer is formed on surfaces of the ferrite particles is obtained.

Preparation of Toner

Preparation of Toner 1

Preparation of Colorant Particle Dispersion 1

Cyan pigment (Copper Phthalocyanine C.I. Pigment Blue 15:3 manufactured by Dainichiseika Color & Chemicals Mfg. Co., Ltd.): 50 parts Anionic surfactant (NEOGEN SC, manufactured by Daiichi Kogyo Seiyaku Co., Ltd.): 5 parts Ion exchange water: 200 parts The above-described components are mixed, are dispersed with ULTRA TURRAX (manufactured by IKA) for five minutes, and are further dispersed in an ultrasonic bath for ten minutes. As a result, Colorant particle dispersion 1 having a solid content of 21% is obtained. The volume average particle diameter is 160 nm when measured using a particle diameter analyzer LA-700 (manufactured by Horiba Ltd.).

Preparation of Release Agent Particle Dispersion (1)

Paraffin wax (HNP-9 manufactured by Nippon Seiro Co., Ltd.): 19 parts

Anionic surfactant (NEOGEN SC, manufactured by Daiichi Kogyo Seiyaku Co., Ltd.): 1 part Ion exchange water: 80 parts The above-described components are mixed in a heat-resistant container, are heated to 90° C., and are stirred for 30 minutes. Next, the molten solution is caused to flow from the bottom of the container to a GAULIN homogenizer. A circulation operation corresponding to three passes is performed under a pressure condition of 5 MPa, and then a circulation operation corresponding to three passes is further performed under an increased pressure of 35 MPa. An emulsion obtained as above is cooled to 40° C. or lower in the heat-resistant container. As a result, Release agent particle dispersion 1 is obtained. The volume average particle diameter is 240 nm when measured using a particle diameter analyzer LA-700 (manufactured by Horiba Ltd.).

Preparation of Resin Particle Dispersion 1

Oil Layer

Styrene (manufactured by Wako Pure Chemical Industries Ltd.): 30 parts n-Butyl acrylate (manufactured by Wako Pure Chemical Industries Ltd.): 10 parts β-carboxyethyl acrylate (manufactured by Rhodia Nicca Ltd.): 1.3 parts Dodecanethiol (manufactured by Wako Pure Chemical Industries Ltd.): 0.4 parts Water Layer 1

Ion exchange water: 17 parts

Anionic surfactant (DAWFAX2A1 manufactured by The Dow Chemical Company): 0.4 parts Water Layer 2

Ion exchange water: 40 parts

Anionic surfactant (DAWFAX2A1 manufactured by The Dow Chemical Company): 0.05 parts Ammonium peroxodisulfate (manufactured by Wako Pure Chemical Industries Ltd.): 0.4 parts The above-described components of the oil Layer and the above-described components of the water Layer 1 are put into a flask, followed by stirring and mixing. As a result, a monomer emulsion dispersion is obtained. The above-described components of the water layer 2 are put into a reaction container, the atmosphere in the container is substituted with nitrogen, and the reaction container is heated in an oil bath under stirring until the internal temperature of the reaction system reaches 75° C. The monomer emulsion dispersion is slowly added dropwise to the inside of the reaction container for three hours, followed by emulsion polymerization. After the completion of the dropwise addition, the polymerization is continued at 75° C. After three hours, the polymerization is finished. As a result, Resin particle dispersion 1 is obtained.

Preparation of Toner Particles

Resin particle dispersion 1: 150 parts

Colorant particle dispersion 1: 30 parts

Release agent particle dispersion 1: 40 parts

Polyaluminum chloride: 0.4 parts

The above-described components are mixed and dispersed in a stainless steel flask using ULTRA TURRAX (manufactured by IKA). Next, the flask is heated to 48° C. in a heating oil bath under stirring. After the flask is held at 48° C. for 80 minutes, 70 parts of Resin particle dispersion 1 is added thereto.

Next, the pH of the system is adjusted to 6.0 using an aqueous sodium hydroxide solution having a concentration 0.5 mol/L, the stainless steel flask is sealed, and a stirring shaft is sealed with a magnetic force. The flask is heated to 97° C. under stirring and is held at this temperature for three hours. After the completion of the reaction, the flask is cooled at a temperature decrease rate of 1° C./min, followed by solid-liquid separation by NUTSCHE suction filtration. The solid is redispersed in 3,000 parts of ion exchange water at 40° C., followed by stirring and washing at 300 rpm for 15 minutes. This washing operation is repeated 5 times, followed by solid-liquid separation by NUTSCHE suction filtration with No. 5A filter paper. Next, the solid is dried in a vacuum for 12 hours. As a result, toner particles are obtained.

Preparation of Toner 1

Silica ($SiO_2$) particles having a volume average particle diameter of 0.03 μm which are surface-treated with a hydrophobizing agent of hexamethyldisilazane are added to the toner particles such that a coverage of the surfaces of the toner particles is 40%, followed by mixing with a HENSCHEL mixer. As a result, Toner 1 is prepared.

Preparation of Developer and Evaluation Thereof 100 parts of each of Carriers 1 to 11 are mixed with 8 parts of Toner 1 to prepare developers according to Examples 1 to 9 and developers according to Comparative Examples 1 and 2. Using these developers, a printing test is performed in a modified machine of DOCUCENTRE COLOR 500 (manufactured by Fuji Xerox Co., Ltd.). In a high-temperature and high-humidity environment (28° C., 80% RH), 10 images of a human image chart in total are continuously printed on plain paper. Next, in a low-temperature and low-humidity environment (10° C., 12% RH), similarly, 10 images in total are continuously printed on plain paper. Regarding these images, image quality is evaluated.

A case where nonuniformity in image quality is visually recognized is evaluated as C, a case where nonuniformity in image quality is barely visually recognized is evaluated as B, and a case where nonuniformity in image quality may not be visually recognized is evaluated as A. The obtained results are shown in Table 1.

TABLE 1

| | Carrier | | | | |
|---|---|---|---|---|---|
| | No. | BET Specific Surface Area of Core Particle | Volume Average Particle diameter of Core Particles | Coating Resin of Resin coat layer | Image Quality Evaluation |
| Example 1 | 1 | 0.07 $m^2/g$ | 36 μm | Dimethylaminoethyl Methacrylate Polymer | A |
| Example 2 | 2 | 0.05 $m^2/g$ | 36 μm | Dimethylaminoethyl Methacrylate Polymer | A |
| Example 3 | 3 | 0.09 $m^2/g$ | 36 μm | Dimethylaminoethyl Methacrylate Polymer | A |
| Comparative Example 1 | 4 | 0.07 $m^2/g$ | 36 μm | Styrene-Methyl Methacrylate Copolymer | C |
| Comparative Example 2 | 5 | 0.15 $m^2/g$ | 36 μm | Dimethylaminoethyl Methacrylate Polymer | C |
| Example 4 | 6 | 0.07 $m^2/g$ | 36 μm | Acryloylmorpholine Polymer | B |
| Example 5 | 7 | 0.07 $m^2/g$ | 20 μm | Dimethylaminoethyl Methacrylate Polymer | B |
| Example 6 | 8 | 0.07 $m^2/g$ | 52 μm | Dimethylaminoethyl Methacrylate Polymer | B |
| Example 7 | 9 | 0.07 $m^2/g$ | 27.5 μm | Dimethylaminoethyl Methacrylate Polymer | A |
| Example 8 | 10 | 0.07 $m^2/g$ | 44.5 μm | Dimethylaminoethyl Methacrylate Polymer | A |
| Example 9 | 11 | 0.07 $m^2/g$ | 36 μm | Dimethylaminopropyl Acrylate Polymer | A |

It may be seen from the above results that, in Examples, nonuniformity in image quality (generation of density unevenness) is prevented as compared to Comparative Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing carrier comprising:

a core particle; and a resin coat layer on a surface of the core particle, wherein the core particle has a BET specific surface area of from 0.05 $m^2/g$ to 0.10 $m^2/g$, the resin coat layer contains a nitrogen-containing (meth) acrylate resin, a content of the nitrogen-containing (meth)acrylate resin in the resin coat layer is from 50% by weight to 100% by weight, a volume average particle diameter of the core particles is from 28 μm to 45 μm, the nitrogen-containing (meth)acrylate resin is a (meth) acrylate resin having an amino group, the resin coat layer contains resin particles, and the electrostatic charge image developing carrier satisfies the following expression:

$$5 \leq A \times B \leq 10:$$

where A represents the volume average particle diameter (nm) of the resin particles, and B represents the BET specific surface area ($m^2/g$) of the core particle.

2. The electrostatic charge image developing carrier according to claim 1, wherein the electrostatic charge image developing carrier is a developing carrier for a trickle development system in which development is performed while replacing the electrostatic charge image developing carrier, that is accommodated in a developing unit, with a new carrier.

3. The electrostatic charge image developing carrier according to claim 1, wherein a volume average particle diameter of the resin particles is from 80 nm to 200 nm.

4. The electrostatic charge image developing carrier according to claim 1, wherein the resin particles are melamine resin particles.

5. An electrostatic charge image developer comprising:

an electrostatic charge image developing toner; and the electrostatic charge image developing carrier according to claim 1.

6. A developer cartridge comprising:

a container that accommodates the electrostatic charge image developer according to claim 5, and is detachable from an image forming apparatus.

7. A process cartridge that is detachable from an image forming apparatus, the process cartridge comprising:

a developing unit that accommodates the electrostatic charge image developer according to claim 5 and develops an electrostatic charge image, which is formed on a surface of an image holding member, using the electrostatic charge image developer to form a toner image.

8. An image forming apparatus comprising:

an image holding member;

a charging unit that charges a surface of the image holding member;

an electrostatic charge image forming unit that forms an electrostatic charge image on the charged surface of the image holding member;

a developing unit that accommodates the electrostatic charge image developer according to claim 5 and develops the electrostatic charge image, which is formed on the surface of the image holding member, using the electrostatic charge image developer to form a toner image;

a transfer unit that transfers the toner image, which is formed on the surface of the image holding member, to a surface of a recording medium; and a fixing unit that fixes the toner image transferred onto the surface of the recording medium.

9. The image forming apparatus according to claim 8, further comprising:

a developer cartridge that accommodates an electrostatic charge image developer, wherein the electrostatic charge image developer comprises:

an electrostatic charge image developing toner; and an electrostatic charge image developing carrier, wherein the electrostatic charge image developing carrier comprises:

a core particle; and a resin coat layer on a surface of the core particle, wherein the core particle has a BET specific surface area of from 0.05 $m^2/g$ to 0.10 $m^2/g$, wherein the resin coat layer contains a nitrogen-containing (meth)acrylate resin, wherein the developer cartridge supplies the electrostatic charge image developer to the developing unit, and wherein the image forming apparatus is an image forming apparatus for a trickle development system in which development is performed while replacing the electrostatic charge image developing carrier, that is accommodated in the developing unit, with a new carrier.

10. The electrostatic charge image developing carrier according to claim 1, wherein a content of the nitrogen-containing (meth)acrylate resin in the resin coat layer is from 70% by weight to 100% by weight.

11. The electrostatic charge image developing carrier according to claim 1, wherein a content of the nitrogen-containing (meth)acrylate resin in the resin coat layer is from 80% by weight to 100% by weight.

12. The electrostatic charge image developing carrier according to claim 1, wherein (meth)acrylate resin having an amino group is selected from the group consisting of 2-vinylpyridine, 4-vinylpyridine, 2-vinyl-6-methylpyridine, 2-vinyl-5-methylpyridine, 4-butenylpyridine, 4-pentenylpyridine, N-vinylpiperidine, 4-vinylpiperidine, N-vinyldihydropyridine, N-vinylpyrrole, 2-vinylpyrrole, N-vinylpyrroline, N-vinylpyrrolidine, 2-vinylpyrrolidine, N-vinyl-2-pyrrolidone, N-vinyl-2-piperidone, N-vinylcarbazole, dimethylaminomethyl acrylate, dimethylaminomethyl methacrylate, dimethylaminoethyl acrylate, dibutylaminoethyl acrylate, dibutylaminomethyl methacrylate, N-cyclohexylmaleimide, and N-phenylmaleimide.

13. The electrostatic charge image developing carrier according to claim 1, wherein (meth)acrylate resin having an amino group is dimethylaminoethyl methacrylate.

* * * * *